US010713991B2

(12) United States Patent
Lee

(10) Patent No.: US 10,713,991 B2
(45) Date of Patent: Jul. 14, 2020

(54) GATE DRIVING DEVICE AND DISPLAY DEVICE HAVING THE SAME

(71) Applicant: Samsung Display Co., Ltd., Yongin-si, Gyeonggi-do (KR)

(72) Inventor: Chang-Soo Lee, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/403,332

(22) Filed: May 3, 2019

(65) Prior Publication Data

US 2020/0020265 A1 Jan. 16, 2020

(30) Foreign Application Priority Data

Jul. 11, 2018 (KR) ..... 10-2018-0080477

(51) Int. Cl.
*G09G 3/20* (2006.01)

(52) U.S. Cl.
CPC ..... *G09G 3/20* (2013.01); *G09G 2310/0264* (2013.01); *G09G 2310/08* (2013.01); *G09G 2330/028* (2013.01); *G09G 2330/04* (2013.01)

(58) Field of Classification Search
CPC .... G09G 3/006; G09G 3/3677; G09G 3/3696; G09G 3/3266; G09G 3/20; G09G 2330/04; G09G 2330/028; G09G 2310/0264; G09G 2310/08; G09G 2310/0289; G09G 2310/12
See application file for complete search history.

(56) References Cited

U.S. PATENT DOCUMENTS

| | | | | |
|---|---|---|---|---|
| 9,275,591 | B2 * | 3/2016 | Bang | G09G 3/3648 |
| 9,570,027 | B2 * | 2/2017 | Kim | G09G 3/3677 |
| 9,779,665 | B2 * | 10/2017 | Song | G09G 3/3233 |
| 10,325,564 | B2 * | 6/2019 | Park | G09G 3/3677 |
| 2011/0069095 | A1 * | 3/2011 | Kim | G09G 3/342 345/690 |
| 2015/0194800 | A1 * | 7/2015 | Kim | G09G 3/3677 361/95 |
| 2016/0225307 | A1 * | 8/2016 | Yoon | G09G 3/2092 |
| 2017/0316728 | A1 * | 11/2017 | Lee | G09G 3/006 |

FOREIGN PATENT DOCUMENTS

| | | |
|---|---|---|
| KR | 10-2015-0081867 A | 7/2015 |
| KR | 10-1772935 B1 | 8/2017 |

* cited by examiner

*Primary Examiner* — Chad M Dicke
(74) *Attorney, Agent, or Firm* — Lewis Roca Rothgerber Christie LLP

(57) ABSTRACT

A display device includes a display panel, a voltage generator configured to generate a gate driving voltage, a timing controller configured to generate a clock control signal, a gate controller configured to generate gate clock signals, a gate driver configured to generate a gate signal, an over current protection circuit configured to generate a gate clock current corresponding to the gate clock signals and output a shutdown control signal, and an abnormal signal detector configured to determine whether the clock control signal is abnormal based on a difference of a set reference signal and the clock control signal, and output a delay control signal that delays an output timing of the shutdown control signal from the over current protection circuit for a set time when the clock control signal is abnormal.

20 Claims, 7 Drawing Sheets

GATE DRIVING DEVICE AND DISPLAY DEVICE HAVING THE SAME

CROSS-REFERENCE TO RELATED APPLICATION(S)

This application claims priority to and the benefit of Korean Patent Application No. 10-2018-0080477, filed on Jul. 11, 2018 in the Korean Intellectual Property Office (KIPO), the content of which is incorporated herein in its entirety by reference.

BACKGROUND

1. Technical Field

Example embodiments relate generally to a gate driving device and a display device having the same.

2. Description of the Related Art

Flat panel display (FPD) devices are widely used as displays for electronic devices because FPD devices are relatively lightweight and thin compared to cathode-ray tube (CRT) display devices. Non-limiting examples of FPD devices are liquid crystal display (LCD) devices, field emission display (FED) devices, plasma display panel (PDP) devices, and organic light emitting display (OLED) devices. A FPD device includes a display panel that displays an image and a driver that drives the display panel. For example, the LCD device may include a liquid crystal display panel in which a plurality of pixels is formed by a plurality of gate lines and a plurality of data lines, a gate driver that outputs a gate signal to the gate line, and a data driver that outputs a data signal to the data line.

An over current protection (OCP) circuit that shuts down the power of the display device may be used when an over current flows due to the defects such as an abnormal signal that outputs from the gate driver, a short between lines, etc. is used. A power unit of the display device that is shut down by the OCP circuit may not operate again. Therefore, the display device may not operate again, as the power unit is shut down due to a temporary electrostatic surge and/or an electric surge.

The above information disclosed in this Background section is only for enhancement of understanding of the background of the invention and therefore it may contain information that does not constitute prior art.

SUMMARY

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

Aspects of example embodiments of the present disclosure relate to a gate driving device and a display device having the same.

Aspects of some example embodiments are directed toward a gate driving device capable of delaying an operation of an OCP circuit by an abnormal signal.

Aspects of some example embodiments are directed toward a display device capable of delaying an operation of an OCP circuit by an abnormal signal.

According to one or more example embodiments, a display device may include a display panel including a plurality of pixels, a voltage generator configured to generate a gate driving voltage, a timing controller configured to generate a clock control signal having a first level in a first period and a second level lower than the first level in a second period, a gate controller configured to generate gate clock signals based on the gate driving voltage and the clock control signal, a gate driver configured to generate a gate signal based on the gate clock signals and provide the gate signal to the pixels, an over current protection circuit configured to detect a gate clock current corresponding to the gate clock signals and output a shutdown control signal that shuts down the voltage generator when the gate clock current is greater than a set or predetermined reference current, and an abnormal signal detector configured to determine whether the clock control signal is abnormal based on a difference of a set or predetermined reference signal and the clock control signal, and output a delay control signal that delays an output timing of the shutdown control signal from the over current protection circuit for a set or predetermined time when the clock control signal is abnormal.

In one or more example embodiments, the abnormal signal detector is configured to compare the reference signal and the clock control signal having the first level in the first period and to compare the reference signal and an inversion signal of the clock control signal having the second level in the second period.

In one or more example embodiments, the abnormal signal detector may include a comparator including a first input terminal that is configured to receive the reference signal, a second input terminal that is configured to receive the clock control signal, and an output terminal that is configured to output a comparing result of the reference signal and the clock control signal, a first switch configured to receive the clock control signal and turn on during the first period, wherein the first switch is coupled to the second input terminal of the comparator, a second switch configured to receive the clock control signal and turn on during the second period, and an inverter coupled between the second switch and the second input terminal.

In one or more example embodiments, the abnormal signal detector may determine that the clock control signal is abnormal when the difference between the reference signal and the clock control signal is greater than a set or predetermined critical value.

In one or more example embodiments, the abnormal signal detector may determine that the clock control signal is abnormal when the reference signal and the clock control signal are different from each other.

In one or more example embodiments, the reference signal may have the same level as the first level of the clock control signal.

In one or more example embodiments, the abnormal signal detector may block the over current protection circuit from outputting the shutdown control signal during the set or predetermined time when the clock control signal is abnormal.

In one or more example embodiments, the abnormal signal detector may output the delay control signal that turns off power of the over current protection circuit when the clock control signal is abnormal.

In one or more example embodiments, the abnormal signal detector may output the delay control signal that turns off a third switch coupled between the over current protection circuit and the voltage generator when the clock control signal is abnormal.

In one or more example embodiments, the abnormal signal detector may output the delay control signal that turns off a fourth switch coupled between the gate controller and the over current protection circuit when the clock control signal is abnormal.

According to one or more example embodiments, a gate driving device may include a voltage generator configured to generate a gate driving voltage, a gate controller configured to generate gate clock signals based on the gate driving voltage and a clock control signal having a first level in a first period and a second level in a second period, a gate driver configured to generate a gate signal based on the gate clock signals, an over current protection circuit configured to detect a gate clock current corresponding to the gate clock signals and output a shutdown control signal that shuts down the voltage generator when the gate clock current is greater than a set or predetermined reference current, and an abnormal signal detector configured to determine whether the clock control signal is abnormal based on a difference between a set or predetermined reference signal and the clock control signal, and output a delay control signal that delays an output timing of the shutdown control signal provided from the over current protection circuit for a set or predetermined time when the clock control signal is abnormal.

In one or more example embodiments, the abnormal signal detector is configured to compare the reference signal and the clock control signal having the first level in the first period and to compare the reference signal and an inversion signal of the clock control signal having the second level in the second period.

In one or more example embodiments, the abnormal signal detector may include a comparator including a first input terminal that is configured to receive the reference signal, a second input terminal that is configured to receive the clock control signal and an output terminal that is configured to output a comparing result of the reference signal and the clock control signal, a first switch configured to receive the clock control signal and turn on during the first period, wherein the first switch is coupled to the second input terminal of the comparator, a second switch configured to receive the clock control signal and turn on during the second period, and an inverter coupled between the second switch and the second input terminal.

In one or more example embodiments, the abnormal signal detector may determine that the clock control signal is abnormal when a difference between the reference signal and the clock control signal is greater than a set or predetermined critical value.

In one or more example embodiments, the abnormal signal detector may determine the clock control signal is abnormal when the reference signal and the clock control signal are different from each other.

In one or more example embodiments, the reference signal may have the same level as the first level of the clock control signal.

In one or more example embodiments, the abnormal signal detector may block the over current protection circuit from outputting the shutdown control signal during the set or predetermined time when the clock control signal is abnormal.

In one or more example embodiments, the abnormal signal detector may output the delay control signal that turn off an operation power of the over current protection circuit when the clock control signal is abnormal.

In one or more example embodiments, the abnormal signal detector may output the delay control signal that turns off a third switch coupled between the over current protection circuit and the voltage generator when the clock control signal is abnormal.

In one or more example embodiments, the abnormal signal detector may output the delay control signal that turns off a fourth switch coupled between the gate controller and the over current protection circuit when the clock control signal is abnormal.

Therefore, according to one or more example embodiments, the gate driving device and the display device having the same may reduce or prevent the voltage generator from shutting down due to the abnormal signal by determining whether the clock control signal is abnormal and delaying an operation of the over current protection circuit when the clock control signal is abnormal. Thus, defect due to the shutdown of the voltage generator may be reduced or prevented.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

The detailed description set forth below in connection with the appended drawings is intended as a description of some example embodiments of a gate driving device and a display device having the same provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the scope of the invention. As denoted elsewhere herein, like element numbers are intended to indicate like elements or features.

Hereinafter, the present inventive concept will be explained in more detail with reference to the accompanying drawings.

Figure 1:
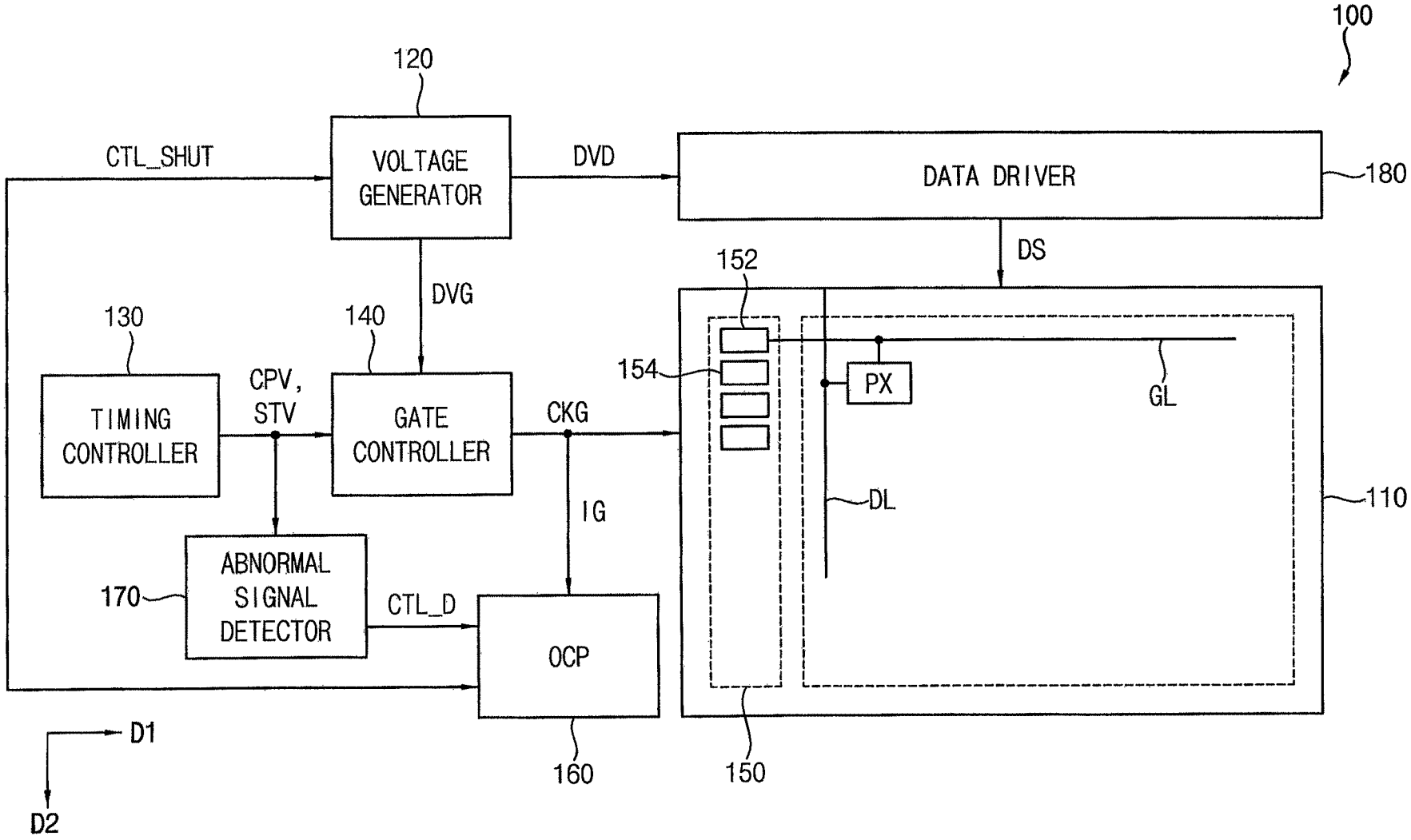
FIG. 1 is a block diagram illustrating a display device according to example embodiments.
Figure 2:
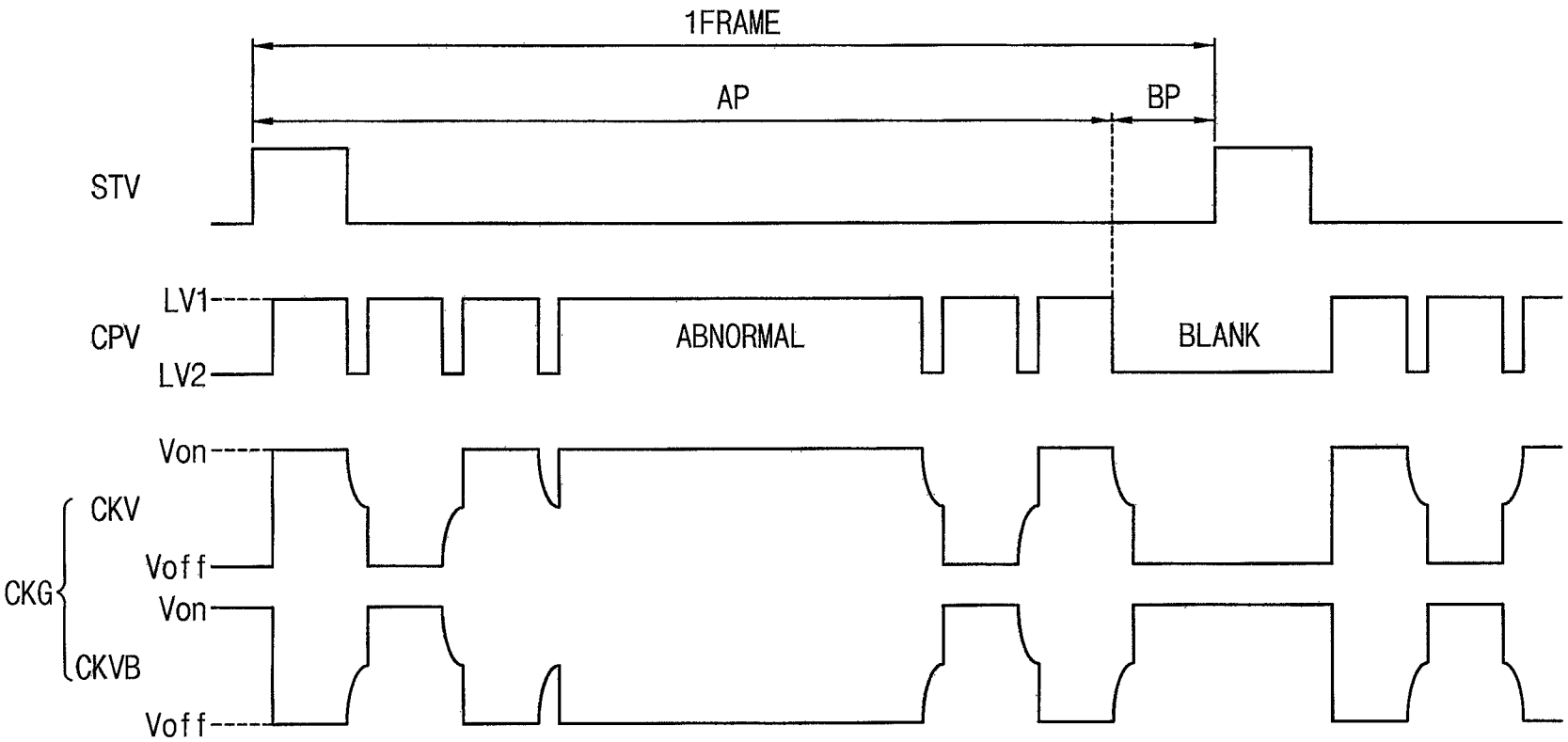
FIG. 2 is a timing diagram illustrating an operation of a gate controller included in the display device of FIG. 1.
Figure 3:
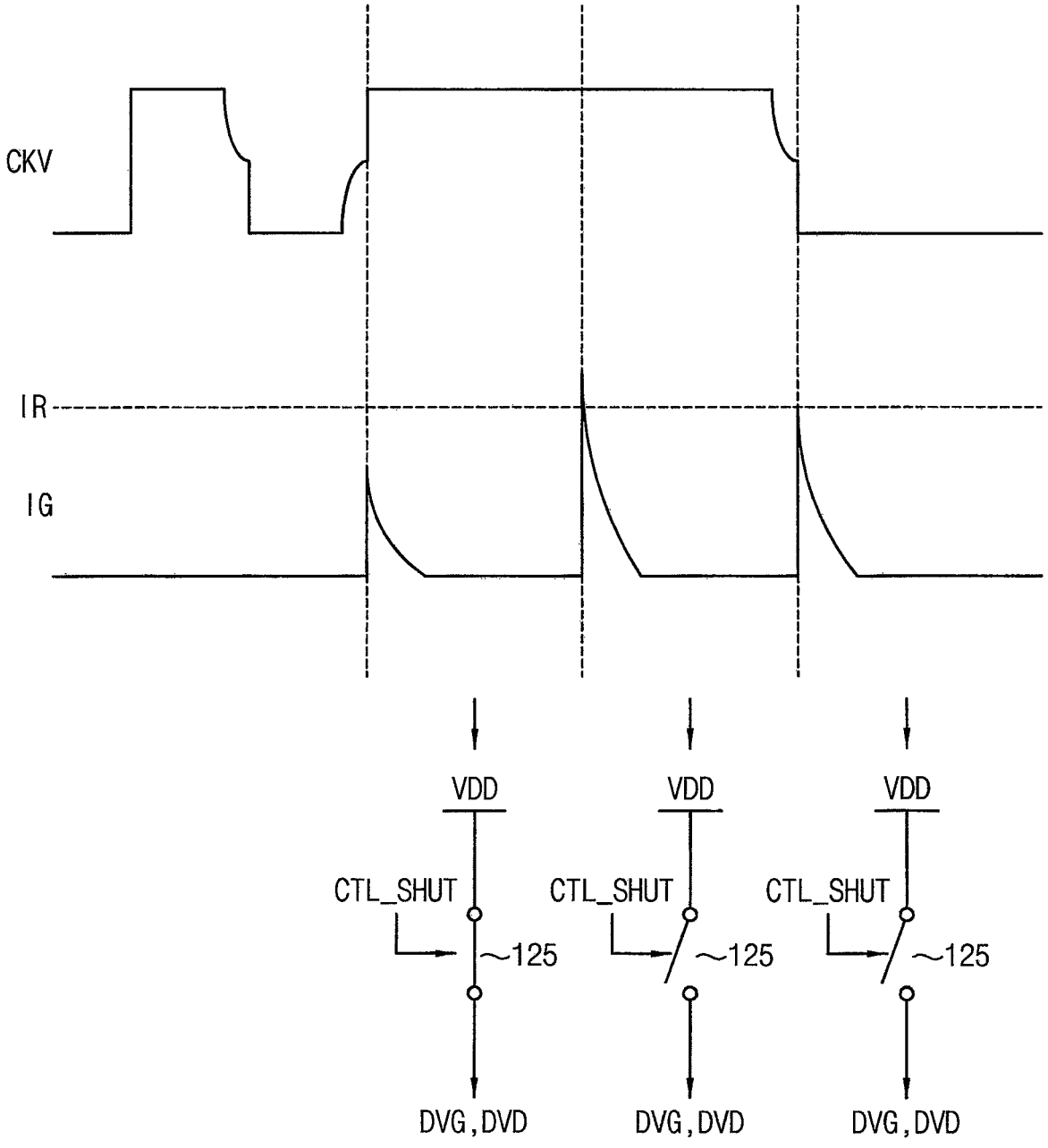
FIG. 3 is a diagram illustrating an operation of an over current protection circuit included in the display device of FIG. 1.

FIG. 1 is a block diagram illustrating a display device according to example embodiments. FIG. 2 is a timing diagram illustrating an operation of a gate controller included in the display device of FIG. 1. FIG. 3 is a diagram illustrating an operation of an over current protection circuit included in the display device of FIG. 1.

Referring to FIG. 1, a display device 100 may include a display panel 110, a voltage generator 120, a timing controller 130, a gate controller 140, a gate driver 150, an over current protection circuit 160, an abnormal signal detector 170, and a data driver 180.

The display panel 110 may include a plurality of data lines DL, a plurality of gate lines GL, and a plurality of pixels PX. The gate lines GL may extend in a first direction D1 and be arranged in a second direction D2, crossing (e.g., perpendicular to) the first direction D1. The data lines DL may extend in the second direction D2 and be arranged in the first direction D1. The first direction D1 may be parallel with a long side of the display panel 110, and the second direction D2 may be parallel with a short side of the display panel 110. Each of the pixels PX may be formed in crossing or intersection regions of the data lines DL and the gate lines GL. In some example embodiments, each of the pixels PX may include a thin film transistor electrically coupled to the data line DL and the gate line GL, a liquid crystal capacitor, and a storage capacitor coupled to the thin film transistor. Thus, the display panel 110 may be a liquid crystal display panel, and the display device 100 may be a liquid crystal display device. In other example embodiments, each of the pixels PX may include a thin film transistor electrically coupled to the data line DL and the gate line GL, a storage capacitor coupled to the thin film transistor, a driving transistor coupled to the storage capacitor, and an organic light emitting diode coupled to the driving transistor. Thus, the display panel 110 may be an organic light emitting display panel, and the display device 100 may be an organic light emitting display device. The display panel 110 may include a display area DA and a non-display area NDA. The pixels PX may be formed in the display area DA and an image may be displayed in the display area DA. The circuits and the lines that generate or provide a signal for driving the pixels PX may be formed in the non-display area NDA.

The voltage generator 120 may receive a direct power VDD from an external device and generate a plurality of voltages to drive the display panel 110. The voltage generator 120 may generate a gate driving voltage DVG provided to the gate controller 140, a data driving voltage DVD provided to the data driver 180, and a panel driving voltage provided to the display panel 110. For example, the voltage generator 120 may generate the gate driving voltage DVG that includes a gate on voltage and a gate off voltage, and provide the gate driving voltage DVG to the gate controller 140. The gate on voltage and the gate off voltage may be a driving voltage to generate a gate signal applied to the gate line GL. The voltage generator 120 may generate the data driving voltage DVD that includes an analog power voltage, a digital power voltage, etc., and provide the data driving voltage DVD to the data driver 180. The analog power voltage and the digital power voltage may be a driving voltage to generate a data signal DS applied to the data line DL. The voltage generator 120 may generate the panel driving voltage that includes a common voltage, a storage voltage, etc., and provide the panel driving voltage to the display panel 110. The common voltage may be a driving voltage applied to the liquid crystal capacitor included in the pixel PX, and the storage voltage may be a driving voltage applied to the storage capacitor included in the pixel PX. The storage voltage may be the same as the common voltage.

The timing controller 130 may generate a clock control signal CPV that controls the gate controller 140. The timing controller 130 may receive a control signal from the external device and generate a vertical start signal STV and the clock control signal CPV provided to the gate controller 140. For example, the clock control signal CPV may have a first level in a first period and a second level lower than the first level in a second period. The timing controller 130 may provide the vertical start signal STV and the clock control signal CPV to the gate controller 140. Further, the timing controller 130 may generate a horizontal start signal and a data clock signal that control the data driver 180. The timing controller 130 may convert a first image data provided from the external device to a second image data. For example, the timing controller may convert the first image data to the second image data by applying an algorithm that compensates display quality. The timing controller 130 may provide the horizontal start signal, the data clock signal, and the second image data to the data driver 180.

The gate controller 140 may generate gate clock signals CKG based on the gate driving voltage DVG and the clock control signal CPV. The gate controller 140 may receive the data driving voltage DVG that includes the gate on voltage and the gate off voltage from the voltage generator 120. Further, the gate controller 140 may receive the vertical start signal STV and the clock control signal CPV from the timing controller 130. The gate controller 140 may receive at least one clock control signal CPV from the timing controller 130. For example, the gate controller 140 may receive a first clock control signal and a second clock control signal from the timing controller 130. The gate controller 140 may generate the gate clock signals CKG that swing between the gate on voltage and the gate off voltage based on the clock control signal CPV. For example, the gate clock signals CKG may include a clock signal and a clock bar signal.

Referring to FIG. 2, the gate controller 140 may generate gate clock signal CKG (e.g., the clock signal CKV and the clock bar signal CKVB) using the gate on voltage Von and the gate off voltage Voff in response to the clock control signal CPV provided from the timing controller 130. One frame may include an active period AP and a blank period BP. The clock control signal CPV may swing between a voltage of first level LV1 and a voltage of second level LV2 in the active period AP, and have the voltage of second level LV2 in the blank period BP. The clock signal CKV and the clock bar signal CKVB may swing between the gate on voltage Von and the gate off voltage Voff in the active period AP and have the gate off voltage Voff during the blank period BP in response to the clock control signal CPV. The gate on voltage Von of the clock signal CKV and the clock bar signal CKVB is higher than the first level LV1 of the clock control signal CPV. The gate off voltage Voff of the clock signal CKV and the clock bar signal CKVB is lower than the second level LV2 of the clock control signal CPV. An abnormal clock control signal CPV may be provided to the gate controller 140 due to an electrostatic surge and/or an electric surge. An abnormal clock signal CKV and the abnormal clock bar signal CKVB may output when the abnormal clock control signal CPV is provided because the clock signal CKV and the clock bar signal CKVB are generated in response to the clock control signal CPV. The abnormal clock control signal CPV may be restored in the same frame or after the blank period BP. When the clock control signal CPV is outputted normally, the clock signal CKV and the clock bar signal CKVB may be normally outputted to swing between the gate on voltage Von and the gate off voltage Voff.

The gate driver 150 may generate the gate signal based on the gate clock signals CKG and provide the gate signal to the pixels PX through the gate lines GL. The gate driver 150 may be formed in the non-display area NDA of the display panel 110. The gate driver 150 may sequentially output the gate signals synchronized with the gate clock signals CKG. The gate driver 150 may include a plurality of stages, for example, 152, 154, or the like. Each of the stages 152, 154, may receive the gate clock signals CKG (e.g., the clock signal CKV and the clock bar signal CKVB) form the gate controller 140. Each of the stages 152, 154 may be coupled to an end of the gate line GL that extends to the display area DA. For example, the first stage 152 may generate a first gate signal based on the gate clock signals CKG and provide the first gate signal through the gate line GL coupled to the pixels PX in a first column. Further, the second stage 154 may generate a second gate signal based on the gate clock signals CKG and provide the second gate signal through the gate line GL coupled to the pixels in a second column. Similarly, the stages of the gate driver 150 may sequentially provide the gate signal to the gate lines GL.

The gate driver 150 may be formed as a plurality of driving chips, mounted on a flexible printed circuit board, and coupled to the display panel 110 in a tape carrier package (TCP) method. Alternatively, the gate driver 150 may be formed as the plurality of driving chips mounted on the non-display area NDA of the display panel 110 in a chip on glass (COG) method. Alternatively, the gate driver 150 may be simultaneously or concurrently formed with the transistors of the pixels PX and mounted on the display panel 110 as amorphous silicon TFT gate driver circuit (ASG) or oxide silicon TFT gate driver circuit (OSG).

The over current protection circuit 160 may detect a gate clock current IG corresponding to the gate clock signals CKG and output a shutdown control signal CTL_SHUT that shuts down the voltage generator 120 when the gate clock current IG is greater than a set or predetermined reference current. The over current protection circuit 160 may detect the gate clock current IG of the gate clock signals CKG in every frame. Referring to FIG. 3, the over current protection circuit 160 may determine that the over current occurs in the gate controller 140 when the gate clock current IG is greater than the reference current IR. The over current protection circuit 160 may output the shutdown control signal CTL_SHUT that shuts down the voltage generator 120 when the over current occurs in the gate controller 140. The voltage generator 120 may not output the gate driving voltage DVG in response to the shutdown control signal CTL_SHUT and deactivate an operation of the gate controller 140. Thus, damages to elements of the display device 100 may be reduced or prevented. For example, the voltage generator 120 may include a switch that blocks or provides the direct power provided from the external device in response to the shutdown control signal CTL_SHUT. When the switch 125 turns off in response to the shutdown control signal CTL_SHUT, the gate driving voltage DVG and the data driving voltage DVD may not be generated.

The abnormal signal detector 170 may determine whether the clock control signal CPV is abnormal based on a difference between a set or predetermined reference signal and the clock control signal CPV, and output a delay control signal CTL_D that delays an output timing of the shutdown control signal CTL_SHUT as a set or predetermined time when the clock control signal CPV is abnormal. The over current may be detected in the gate controller 140 due to the electrostatic surge and/or a short between lines in the gate controller 140. As described in FIG. 2, although the clock control signal CPV abnormally outputs due to the electrostatic surge, the electric surge, etc., the clock control signal CPV may be restored to normal as time passes. The abnormal signal detector 170 may delay the output timing of the shutdown control signal CTL_SHUT form the over current protection circuit 160 during the time in which the abnormal clock control signal CPV is restored to normal. Thus, the abnormal signal detector 170 may protect or prevent the voltage generator 120 from immediately shutting down. For example, the abnormal signal detector 170 may output the delay control signal CTL_D during one frame or two frames.

The abnormal signal detector 170 may determine whether the clock control signal CPV is abnormal by comparing the reference signal and the clock control signal CPV having the first level in the first period and comparing the reference signal and the clock signal CPV having the second level in the second period. In some example embodiments, the abnormal signal detector 170 may determine that the clock control signal CPV is abnormal when the difference between the reference signal and the clock control signal CPV is greater than a set or predetermined critical value. In other example embodiments, the abnormal signal detector 170 may determine that the clock control signal CPV is abnormal when the reference signal and the clock control signal CPV are different from each other. Here, the reference signal may have the same level as the first level of the clock control signal CPV. The abnormal signal detector 170 may block or prevent the over current protection circuit 160 from outputting the shutdown control signal CTL_SHUT in the set or predetermined time when the clock control signal CPV is abnormal. In some example embodiments, the abnormal signal detector 170 may output the delay control signal CTL_D that turns off the power of the over current protection circuit 160 when the clock control signal CPV is abnormal. In other example embodiments, the abnormal signal detector 170 may output the delay control signal CTL_D that turns off a switch coupled between the over current protection circuit 160 and the voltage generator 120 when the clock control signal CPV is abnormal. In other example embodiments, the abnormal signal detector 170 may output the delay control signal CTL_D that turns off a switch coupled between the gate controller 140 and the over current protection circuit 160.

The over current protection circuit 160 may output the shutdown control signal CTL_SHUT after the set or predetermined time in response to the delay control signal CTL_D provided from the abnormal signal detector 170, although the over current is detected. Thus, the voltage generator 120 may not shut down when the abnormal signal is temporarily provided. When the over current is detected and the delay control signal CTL_D is not provided, the over current protection circuit 160 may determine that the short between the lines has occurred and immediately output the shutdown control signal CTL_SHUT. Thus, the damage to the elements of the display device 100 may be reduced or prevented.

Although the display device 100, that includes each of the voltage generator 120 that generates the gate driving voltage DVG, the gate controller 140 that generates the gate clock signals CKG, the gate driver 150 that generates the gate signal, the over current protection circuit 160 that detects the over current of the gate clock signals CKG and shuts down the voltage generator 120, and the abnormal signal detector 170 that delays the operation of the over current protection circuit 160 when the abnormal signal is detected, is described as being arranged as in FIG. 1, the voltage generator 120, the gate controller 140, the gate driver 150, the over current protection circuit 160, and the abnormal signal detector 170, may be more specifically arranged as a gate driving device of the display device 100.

In FIG. 1, the data driver 180 may provide the data signal DS to the pixels PX through the data line DL. The data driver 180 may generate the data signal DS based on the data control signal and the second image data provided from the timing controller 130. The data control signal may include the horizontal start signal and the data clock signal. The data driver 180 may output the data signal corresponding to the second image data to the data lines DL in the display panel 110 in response to the horizontal start signal and the data clock signal.

As described above, the display device 100 of FIG. 1 may determine whether the clock control signal CPV is abnormal and prevent or block the voltage generator 120 from shutting down in response to abnormal signal temporarily provided by delaying the operation of the over current protection circuit 160 when the abnormal clock control signal CPV is provided. Thus, defects that occur by the shutdown of the voltage generator 120 may be reduced or prevented.

Figure 4:
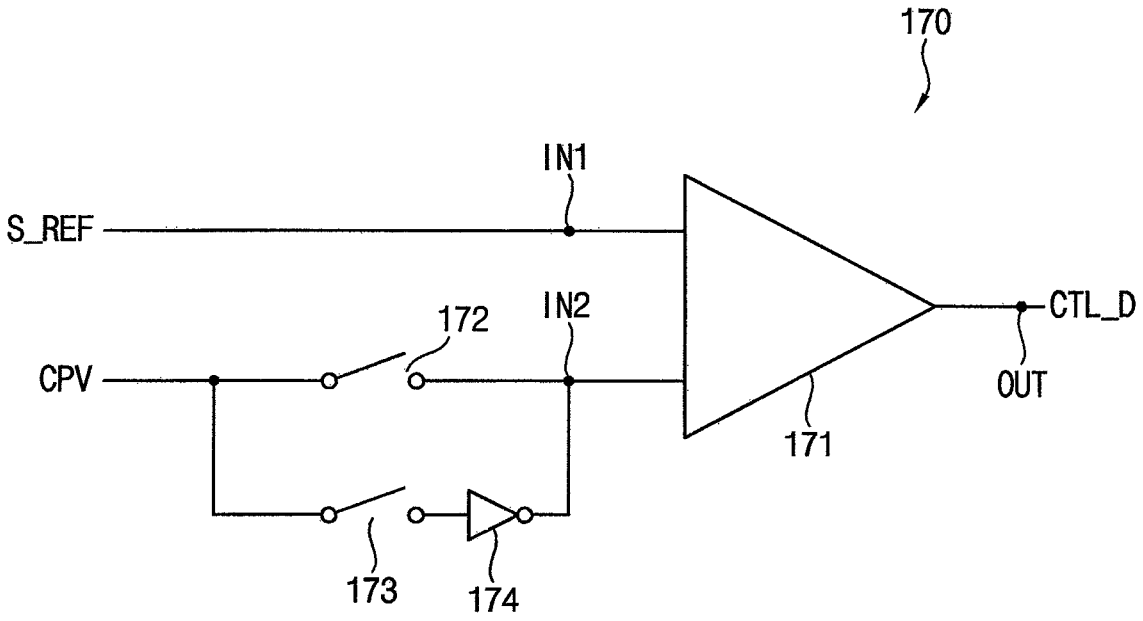
FIG. 4 is a block diagram illustrating an example of an abnormal signal detector included in the display device of FIG. 1.

FIG. 4 is a block diagram illustrating an example of an abnormal signal detector 170 included in the display device of FIG. 1.

Referring to FIG. 4, the abnormal signal detector 170 may include a comparator 171, a first switch 172, a second switch 173, and an inverter 174.

The comparator 171 may include a first input terminal IN1, a second input terminal IN2, and an output terminal OUT. The reference signal S_REF may be provided through the first input terminal IN1, the clock control signal CPV may be provided through the second input terminal IN2, and a comparing result of the reference signal S_REF and the clock control signal CPV may be outputted as the delay control signal CTL_D through the output terminal OUT.

The reference signal S_REF may have the same level as the first level of the clock control signal CPV and may be provided to the comparator 171 through the first input terminal IN1. The clock control signal CPV may include a first period and a second period. The clock control signal CPV having the first level may be outputted during the first period, and the clock control signal CPV having the second level may be outputted during the second period. The first switch 172 may receive the clock control signal CPV and turn on during the first period. The first switch 172 may be coupled to the second input terminal IN2 of the comparator 171. That is, the first switch 172 may turn on, and the clock control signal CPV having the first level may be provided to the second input terminal IN2 through the first switch 172, during the first period. The second switch 173 may receive the clock control signal CPV and turn on during the second period. Further, the inverter 174 may be coupled between the second switch 173 and the second input terminal IN2. That is, when the second switch 173 turns on, the clock control signal CPV having the second level may be provided to the inverter 174 through the second switch 173, and an inversion signal of the clock control signal CPV may be provided to the second input terminal IN2 during the second period. For example, when the second level of the clock control signal CPV is a negative number, the inversion signal having a positive number may be provided to the second input terminal IN2.

The comparator 171 may compare the reference signal S_REF and the clock control signal CPV having the first level during the first period and compare the reference signal S_REF and the clock control signal CPV having the second level during the second period. In some example embodiments, the comparator 171 may output the delay control signal CTL_D that delays the operation of the over current protection circuit 160 through the output terminal OUT when the difference between the reference signal S_REF and the clock control signal CPV is greater than the set or predetermined critical value. In other example embodiments, the comparator 171 may output the delay control signal CTL_D that delays the operation of the over current protection circuit 160 through the output terminal OUT when the reference signal S_REF and the clock control signal CPV are different from each other. Here, the reference signal S_REF may have the same level as the first level of the clock control signal CPV. The comparator 171 may output the delay control signal CTL_D during the set or predetermined time. For example, the delay control signal CTL_D may output during one frame or two frames.

Figure 5A:
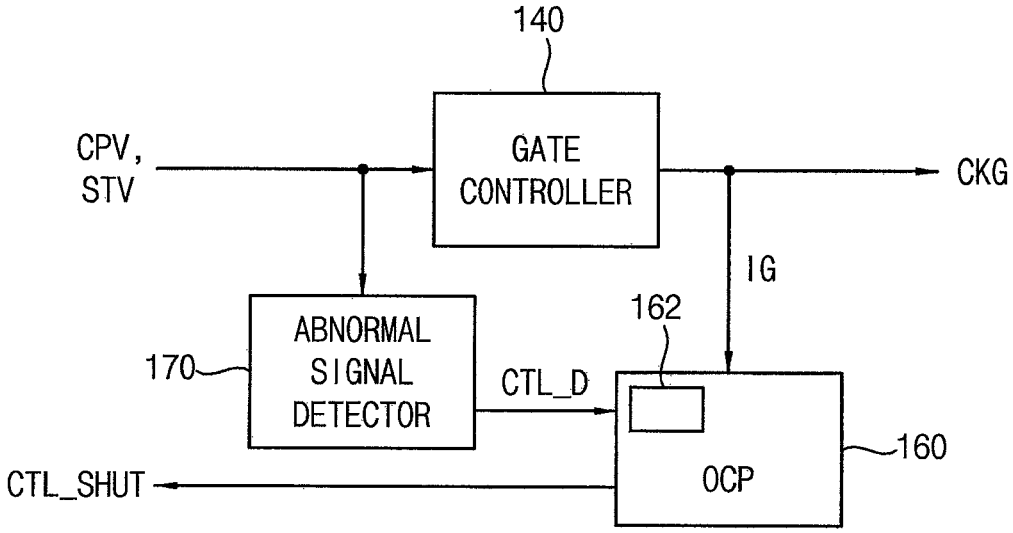
FIGS. 5A-5C are diagrams illustrating an operation of an abnormal signal detector included in the display device of FIG. 1.
Figure 5B:
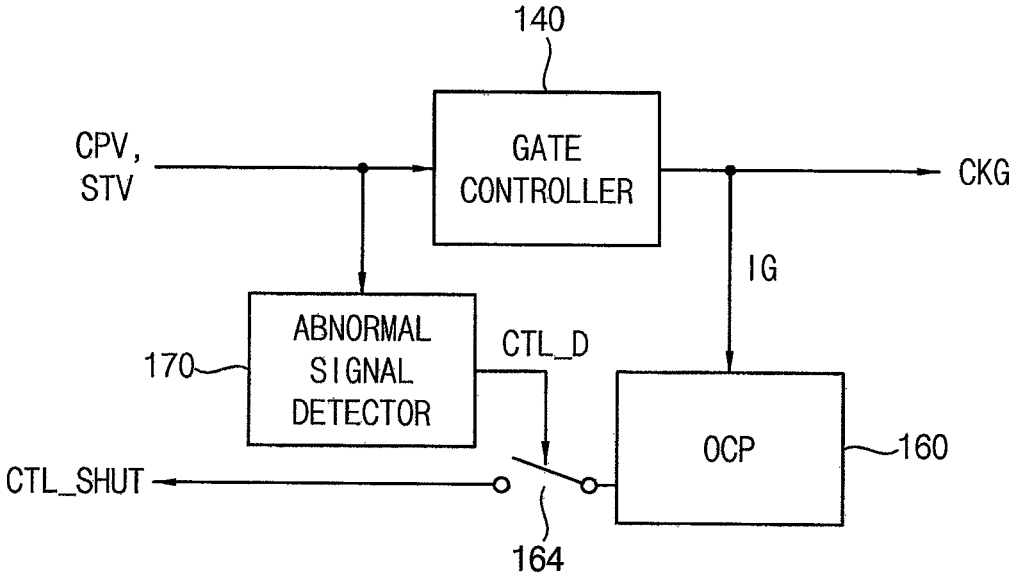
Figure 5C:
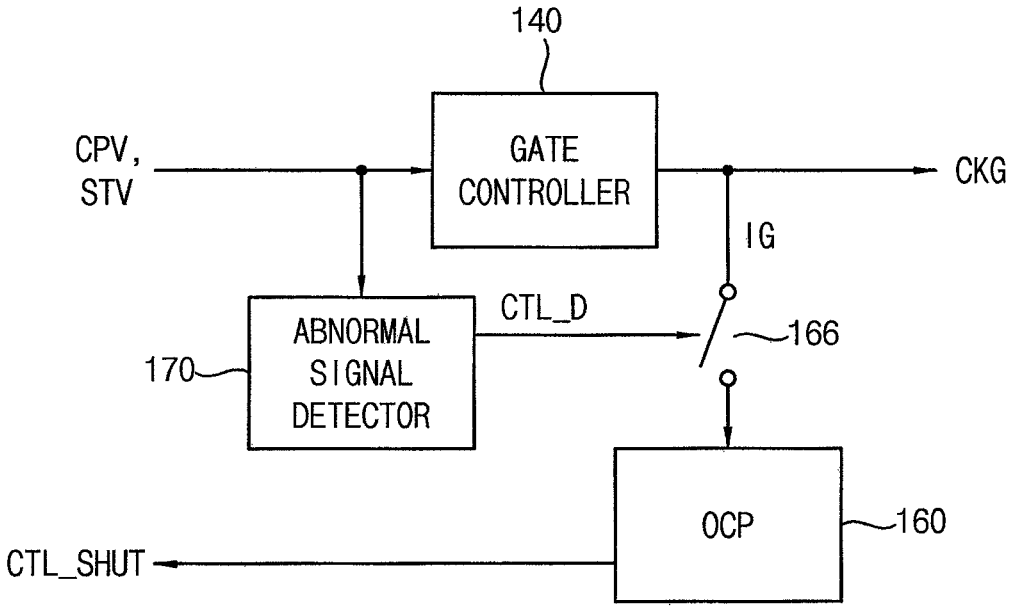

FIGS. 5A-5C are diagrams illustrating an operation of an abnormal signal detector included in the display device of FIG. 1.

Referring to FIG. 5A, the abnormal signal detector 170 may provide the delay control signal CTL_D to the over current protection circuit 160. The abnormal signal detector 170 may provide the delay control signal CTL_D to a power unit in the over current protection circuit 160. The abnormal signal detector 170 may output the delay control signal CTL_D that turns off the power unit 162 of the over current protection circuit 160 during the set or predetermined time when the clock control signal CPV is abnormal. Thus, the over current protection circuit 160 may provide the shutdown control signal CTL_SHUT after the set or predetermined time when the gate current IG corresponding to the gate clock signals CKG is greater than the reference current (e.g., when the over current is detected).

Referring to FIG. 5B, a third switch 164 may be coupled between the over current protection circuit 160 and the voltage generator. The abnormal signal detector 170 may output the delay control signal CTL_D that turns off the third switch 164 during the set or predetermined time when the clock control signal CPV is abnormal. Thus, the over current protection circuit 160 may provide the shutdown control signal CTL_SHUT after the set or predetermined time when the gate current IG corresponding to the gate clock signals CKG is greater than the reference current (e.g., when the over current is detected).

Referring to FIG. 5C, a fourth switch 166 may be coupled between the gate controller 140 and the over current protection circuit 160. The abnormal signal detector 170 may output the delay control signal CTL_D that turns off the fourth switch 166 during the set or predetermined time when the clock control signal CPV is abnormal. Thus, the over current protection circuit 160 may provide the shutdown control signal CTL_SHUT after the set or predetermined time when the gate current IG corresponding to the gate clock signals CKG is greater than the reference current (e.g., when the over current is detected).

Figure 6:
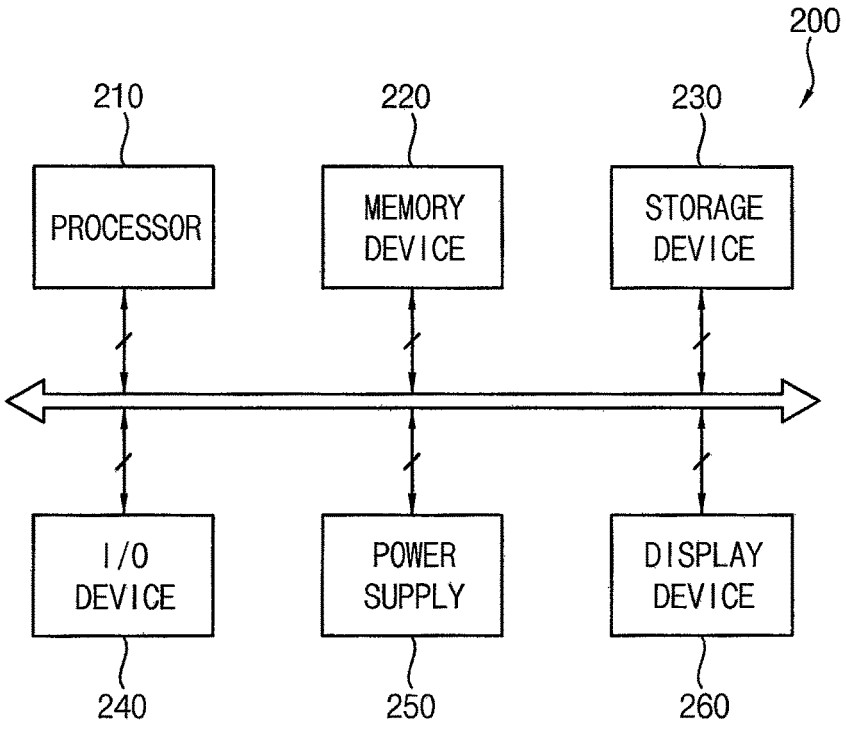
FIG. 6 is a block diagram illustrating an electronic device that includes the display device of FIG. 1.
Figure 7:
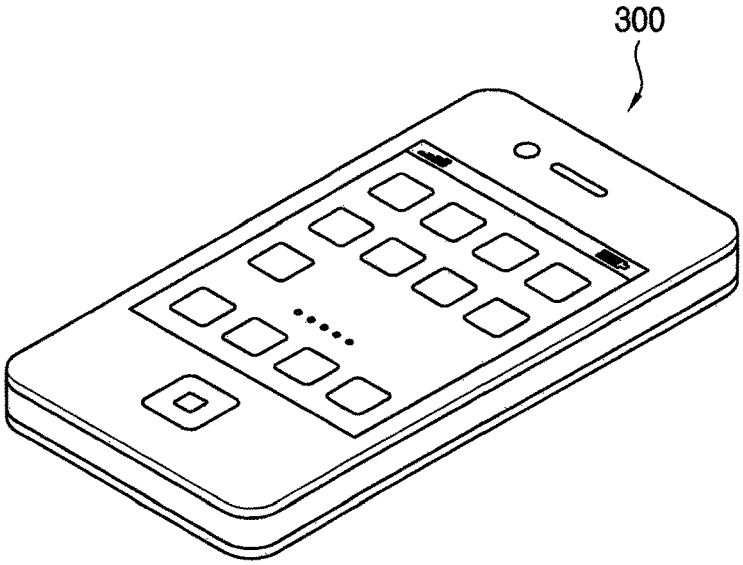
FIG. 7 is a diagram illustrating an example embodiment in which the electronic device of FIG. 6 is implemented as a smart phone.

FIG. 6 is a block diagram illustrating an electronic device that includes the display device of FIG. 1 and FIG. 7 is a diagram illustrating an example embodiment in which the electronic device of FIG. 6 is implemented as a smart phone.

Referring to FIGS. 6 and 7, an electronic device 200 may include a processor 210, a memory device 220, a storage device 230, an input/output (I/O) device 240, a power device 250, and a display device 260. Here, the display device 260 may correspond to the display device 100 of FIG. 1. In addition, the electronic device 200 may further include a plurality of ports for communicating a video card, a sound card, a memory card, a universal serial bus (USB) device, other electronic devices, etc. Although it is illustrated in FIG. 7 that the electronic device 200 is implemented as a smart phone 300, a kind of the electronic device 200 is not limited thereto.

The processor 210 may perform various computing functions. The processor 210 may be a micro-processor, a central processing unit (CPU), etc. The processor 210 may be coupled to other components via an address bus, a control bus, a data bus, etc. Further, the processor 210 may be coupled to an extended bus such as peripheral component interconnect (PCI) bus. The memory device 220 may store data for operations of the electronic device 200. For example, the memory device 220 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 230 may be a solid stage drive (SSD) device, a hard disk drive (HDD) device, a CD-ROM device, etc.

The I/O device 240 may be an input device such as a keyboard, a keypad, a touchpad, a touch-screen, a mouse, etc, and an output device such as a printer, a speaker, etc. In some example embodiments, the display device 260 may be included in the I/O device 240. The power device 250 may provide power for operations of the electronic device 200. The display device 260 may communicate with other components via the buses or other communication links.

As described above, the display device 260 may include a display panel, a voltage generator, a timing controller, a gate controller, a gate driver, an over current protection circuit, an abnormal signal detector, and a data driver. The display panel may include a plurality of pixels. Each of the pixels may be coupled to gate lines and data lines. The voltage generator may receive a direct power from an external device and generate a plurality of voltages to drive the display panel. For example, the voltage generator may generate a gate driving voltage provided to the gate controller, a data driving voltage provided to the data driver, and a panel driving voltage provided to the display panel. The timing controller may receive a control signal from the external device and generate a clock control signal provided to the gate controller and a data clock signal provided to the data driver. Further, the timing controller may compensate a first image data provided from the external device to a second image data and provide the second image data to the data driver. The gate controller may generate gate clock signals based on the gate driving voltage and the clock control signal. The gate controller may receive the gate driving voltage that includes a gate on voltage and a gate off voltage from the gate generator. Further, the gate controller may receive the clock control signal from the timing controller. The gate controller may generate gate clock signals that swing between the gate on voltage and the gate off voltage based on the clock control signal. For example, the gate clock signals may include a clock signal and a clock bar signal. The gate driver may generate a gate signal based on the gate clock signals and provide the gate signal to the pixels through the gate line GL. The gate driver may include a plurality of stages. Each of the stages may sequentially output the gate signals synchronized with the gate clock signals. The over current protection circuit may detect a gate clock current corresponding to the gate clock signal and output a shutdown control signal that shuts down the voltage generator when the gate clock current is greater than a set or predetermined reference current. The abnormal signal detector may determine whether the clock control signal is abnormal based on a difference between a set or predetermined reference signal and the clock control signal, and output a delay control signal that delays an output timing of the shutdown control signal for a set or predetermined time when the clock control signal is abnormal. The clock control signal may be restored as time passes, although the clock control signal is temporarily abnormal due to an electrostatic surge, an electric surge, etc. The abnormal signal detector may delay the output timing of the shutdown control signal while the clock control signal is restored. Thus, the voltage generator may not be immediately shut down. The abnormal signal detector may determine whether the clock control signal is abnormal by comparing the reference signal to the clock control signal having a first level during a first period and comparing the reference signal to the clock control signal having a second level during a second period. The over current protection circuit may output the shutdown control signal after the set or predetermined time in response to the delay control signal provided from the abnormal signal detector, when the over current is detected. Thus, the voltage generator may not shut down when the abnormal signal is just temporarily provided.

As described above, the electronic device 200 of FIG. 6 may include the display device 260 that protects or prevents the voltage generator from immediately shutting down due to the temporary abnormal signal, by determining whether the clock control signal is abnormal and delaying the operation of the over current protection circuit when the clock control signal is abnormal. Thus, defects that occur due to the shutdown of the voltage generator may be reduced or prevented.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and equivalents thereof.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art.

As used herein, the singular forms "a" and "an" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present invention". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

Any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Although exemplary embodiments of a gate driving device and a display device having the same have been specifically described and illustrated herein, many modifications and variations will be apparent to those skilled in the art. Accordingly, it is to be understood that to a gate driving device and a display device having the same constructed according to principles of this invention may be embodied other than as specifically described herein. The invention is also defined in the following claims, and equivalents thereof.

What is claimed is:

1. A display device comprising:

a display panel comprising a plurality of pixels;

a voltage generator configured to generate a gate driving voltage;

a timing controller configured to generate a clock control signal having a first level in a first period and a second level lower than the first level in a second period;

a gate controller configured to generate gate clock signals based on the gate driving voltage and the clock control signal;

a gate driver configured to generate a gate signal based on the gate clock signals and provide the gate signal to the pixels;

an over current protection circuit configured to detect a gate clock current corresponding to the gate clock signals and output a shutdown control signal that shuts down the voltage generator when the gate clock current is greater than a set reference current; and an abnormal signal detector configured to determine whether the clock control signal is abnormal based on a difference of a set reference signal and the clock control signal, and output a delay control signal that delays an output timing of the shutdown control signal from the over current protection circuit for a set time when the clock control signal is abnormal.

2. The display device of claim 1, wherein the abnormal signal detector is configured to compare the reference signal and the clock control signal having the first level in the first period and to compare the reference signal and an inversion signal of the clock control signal having the second level in the second period.

3. The display device of claim 1, wherein the abnormal signal detector comprises:

a comparator comprising a first input terminal that is configured to receive the reference signal, a second input terminal that is configured to receive the clock control signal, and an output terminal that is configured to output a comparing result of the reference signal and the clock control signal;

a first switch configured to receive the clock control signal and turn on during the first period, wherein the first switch is coupled to the second input terminal of the comparator;

a second switch configured to receive the clock control signal and turn on during the second period; and an inverter coupled between the second switch and the second input terminal.

4. The display device of claim 1, wherein the abnormal signal detector determines that the clock control signal is abnormal when the difference between the reference signal and the clock control signal is greater than a set critical value.

5. The display device of claim 1, wherein the abnormal signal detector determines that the clock control signal is abnormal, when the reference signal and the clock control signal are different from each other.

6. The display device of claim 1, wherein the reference signal has the same level as the first level of the clock control signal.

7. The display device of claim 1, wherein the abnormal signal detector blocks the over current protection circuit from outputting the shutdown control signal during the set time, when the clock control signal is abnormal.

8. The display device of claim 1, wherein the abnormal signal detector outputs the delay control signal that turns off power of the over current protection circuit, when the clock control signal is abnormal.

9. The display device of claim 1, wherein the abnormal signal detector outputs the delay control signal that turns off a third switch coupled between the over current protection circuit and the voltage generator, when the clock control signal is abnormal.

10. The display device of claim 1, wherein the abnormal signal detector outputs the delay control signal that turns off a fourth switch coupled between the gate controller and the over current protection circuit, when the clock control signal is abnormal.

11. A gate driving device comprising:

a voltage generator configured to generate a gate driving voltage;

a gate controller configured to generate gate clock signals based on the gate driving voltage and a clock control signal having a first level in a first period and a second level in a second period;

a gate driver configured to generate a gate signal based on the gate clock signals;

an over current protection circuit configured to detect a gate clock current corresponding to the gate clock signals and output a shutdown control signal that shuts down the voltage generator when the gate clock current is greater than a set reference current; and an abnormal signal detector configured to determine whether the clock control signal is abnormal based on a difference between a set reference signal and the clock control signal, and output a delay control signal that delays an output timing of the shutdown control signal from the over current protection circuit for a set time when the clock control signal is abnormal.

12. The gate driving device of claim 11, wherein the abnormal signal detector is configured to compare the reference signal and the clock control signal having the first level in the first period and to compare the reference signal and an inversion signal of the clock control signal having the second level in the second period.

13. The gate driving device of claim 11, wherein the abnormal signal detector comprises:

a comparator comprising a first input terminal that is configured to receive the reference signal, a second input terminal that is configured to receive the clock control signal and an output terminal that is configured to output a comparing result of the reference signal and the clock control signal;

a first switch configured to receive the clock control signal and turn on during the first period, wherein the first switch is coupled to the second input terminal of the comparator;

a second switch configured to receive the clock control signal and turn on during the second period; and an inverter coupled between the second switch and the second input terminal.

14. The gate driving device of claim 11, wherein the abnormal signal detector determines that the clock control signal is abnormal when a difference between the reference signal and the clock control signal is greater than a set critical value.

15. The gate driving device of claim 11, wherein the abnormal signal detector determines the clock control signal is abnormal when the reference signal and the clock control signal are different from each other.

16. The gate driving device of claim 11, wherein the reference signal has the same level as the first level of the clock control signal.

17. The gate driving device of claim 11, wherein the abnormal signal detector blocks the over current protection circuit from outputting the shutdown control signal during the set time, when the clock control signal is abnormal.

18. The gate driving device of claim 11, wherein the abnormal signal detector outputs the delay control signal that turn off an operation power of the over current protection circuit, when the clock control signal is abnormal.

19. The gate driving device of claim 11, wherein the abnormal signal detector outputs the delay control signal that turns off a third switch coupled between the over current protection circuit and the voltage generator, when the clock control signal is abnormal.

20. The gate driving device of claim 11, wherein the abnormal signal detector outputs the delay control signal that turns off a fourth switch coupled between the gate controller and the over current protection circuit, when the clock control signal is abnormal.

* * * * *